US009863237B2

(12) United States Patent
Comparetto

(10) Patent No.: US 9,863,237 B2
(45) Date of Patent: Jan. 9, 2018

(54) ELECTROMAGNETIC TELEMETRY APPARATUS AND METHODS FOR USE IN WELLBORE APPLICATIONS

(71) Applicant: Joseph E. Comparetto, Wylie, TX (US)

(72) Inventor: Joseph E. Comparetto, Wylie, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 125 days.

(21) Appl. No.: 13/685,313

(22) Filed: Nov. 26, 2012

(65) Prior Publication Data

US 2014/0145857 A1 May 29, 2014

(51) Int. Cl.
*G01V 3/00* (2006.01)
*E21B 47/12* (2012.01)

(52) U.S. Cl.
CPC ..... *E21B 47/122* (2013.01); *E21B 47/12* (2013.01)

(58) Field of Classification Search
CPC ..... G08C 17/02; G08C 23/04; E21B 47/12; E21B 47/122
USPC ..... 340/850–854; 166/250.01; 324/338
See application file for complete search history.

(56) References Cited

U.S. PATENT DOCUMENTS 4,578,675 A 3/1986 MacLeod
4,684,946 A * 8/1987 Issenmann ..... E21B 17/003 175/50
4,839,644 A 6/1989 Safinya et al.
5,339,037 A 8/1994 Bonner et al.
5,745,047 A * 4/1998 Van Gisbergen et al. . 340/853.1
6,160,492 A 12/2000 Herman
6,184,685 B1 * 2/2001 Paulk et al. ..... 324/338
6,515,592 B1 * 2/2003 Babour et al. ..... 340/854.4
6,678,616 B1 * 1/2004 Winkler et al. ..... 702/6
7,227,363 B2 6/2007 Gianzero et al.
7,436,183 B2 10/2008 Clark
7,554,458 B2 * 6/2009 Hudson et al. ..... 340/854.9
7,692,428 B2 * 4/2010 Clark et al. ..... 324/338
7,806,180 B2 * 10/2010 Hudson ..... 166/250.01
7,960,969 B2 * 6/2011 Mouget et al. ..... 324/221
8,122,958 B2 2/2012 Vestavik
8,330,463 B2 * 12/2012 Blanz ..... 324/338
2002/0101242 A1 * 8/2002 Bittar ..... G01V 3/30 324/338

(Continued)

FOREIGN PATENT DOCUMENTS

CN 101054898 B 7/2011

OTHER PUBLICATIONS

PCT International Search Report and Written Opinion; International Application No. PCT/US2013/066274; International Filng Date: Oct. 23, 2013; dated Feb. 17, 2014; pp. 1-9.

(Continued)

*Primary Examiner* — Ryan Sherwin
(74) *Attorney, Agent, or Firm* — Cantor Colburn LLP

(57) ABSTRACT

In one aspect, an apparatus for use in a wellbore is disclosed that may include a transmitter placed on an electrically-conductive member at a first location in the wellbore configured to induce electromagnetic waves that travel along an outside of the conduit and a receiver placed on the electrically-conductive member at a second distal location in the wellbore configured to detect the electromagnetic waves induced by the transmitter.

23 Claims, 3 Drawing Sheets

(56) References Cited

U.S. PATENT DOCUMENTS

| | | | | |
|---|---|---|---|---|
| 2003/0098157 | A1 | 5/2003 | Hales et al. | |
| 2003/0178205 | A1* | 9/2003 | Henderson | 166/387 |
| 2004/0263414 | A1* | 12/2004 | Chen | G01V 3/28 343/895 |
| 2005/0218898 | A1 | 10/2005 | Fredette et al. | |
| 2006/0044155 | A1* | 3/2006 | Le Briere et al. | 340/854.3 |
| 2006/0202806 | A1 | 9/2006 | Bonner et al. | |
| 2007/0216415 | A1* | 9/2007 | Clark | E21B 47/011 324/338 |
| 2008/0030415 | A1 | 2/2008 | Homan et al. | |
| 2008/0290873 | A1 | 11/2008 | Homan et al. | |
| 2009/0038793 | A1* | 2/2009 | Schmitt et al. | 166/250.01 |
| 2009/0091327 | A1 | 4/2009 | Blanz | |
| 2009/0160449 | A1 | 6/2009 | Martinez et al. | |
| 2009/0166023 | A1* | 7/2009 | Svenning et al. | 166/65.1 |
| 2009/0302847 | A1* | 12/2009 | Knizhnik | G01V 3/18 324/332 |
| 2010/0013663 | A1 | 1/2010 | Cavender et al. | |
| 2010/0327681 | A1* | 12/2010 | Perry | 310/71 |
| 2012/0094701 | A1* | 4/2012 | Jensen et al. | 455/500 |
| 2013/0014992 | A1* | 1/2013 | Sharp | E21B 47/024 175/45 |

OTHER PUBLICATIONS

PCT International Search Report and Written Opinion; International Application No. PCT/US2014/04523; International Filing Date: Jun. 16, 2014; dated Oct. 21, 2014; pp. 1-12.

* cited by examiner

ELECTROMAGNETIC TELEMETRY APPARATUS AND METHODS FOR USE IN WELLBORE APPLICATIONS

BACKGROUND

1. Field of the Disclosure

This disclosure relates generally to wireless electromagnetic telemetry for use in wellbore operations.

2. Background of the Art

Wellbores are drilled in subsurface formations for the production of hydrocarbons (oil and gas). Modern wells can extend to great depths, often more than 1500 meters (or 15,000 ft.). Various methods have been used for communicating information from the surface to devices in the wellbore, both for production wells and for wells being drilled. In production wells, hard wired, acoustic and electromagnetic telemetry methods have been proposed. During drilling, the predominant telemetry method is mud pulse telemetry wherein pressure pulses in the drilling muds are created at the surface and transmitted through the flowing mud into the drill string. The mud pulse telemetry technique is extremely slow, such as a few bits per minute. The acoustic and electromagnetic telemetry systems have not been very reliable and successful. Hard wiring can be problematic due to the harsh down-hole environment and is also very expensive. There is a need for a more reliable telemetry system for use in well operations.

The present disclosure provides an electromagnetic telemetry system and method that addresses some of the above-stated issues.

SUMMARY

In one aspect, a telemetry apparatus is provided that in one embodiment may include an electrically-conductive member in a wellbore, a transmitter with an antenna coil wrapped around the outside of an electrically-conductive member at a first location that induces electromagnetic waves that travel along the electrically-conductive member, and a receiver with an antenna coil wrapped around the outside of the electrically-conductive member at a second distal location that detects the induced electromagnetic waves.

In another aspect a telemetry method is disclosed that in one embodiment may include transmitting electromagnetic waves representing data along an outer surface of an electrically-conductive member in a wellbore using a transmitter with an antenna coil wrapped around the outside of the member and disposed at a first location on the member, receiving electromagnetic waves responsive to the transmitted electromagnetic waves using a receiver with an antenna coil wrapped around the outside of the member and disposed at a second distal location on the electrically conductive member, and processing the received electromagnetic waves to determine the data.

Examples of the more important features of a system and method for monitoring a physical condition of a production well equipment and controlling well production have been summarized rather broadly in order that the detailed description thereof that follows may be better understood, and in order that the contributions to the art may be appreciated. There are, of course, additional features that will be described hereinafter and which will form the subject of the claims.

BRIEF DESCRIPTION OF THE DRAWINGS

For a detailed understanding of the apparatus and methods disclosed herein, reference should be made to the accompanying drawings and the detailed description thereof, wherein like elements generally have been given like numerals, and wherein.

DETAILED DESCRIPTION OF THE DRAWINGS

Figure 1:
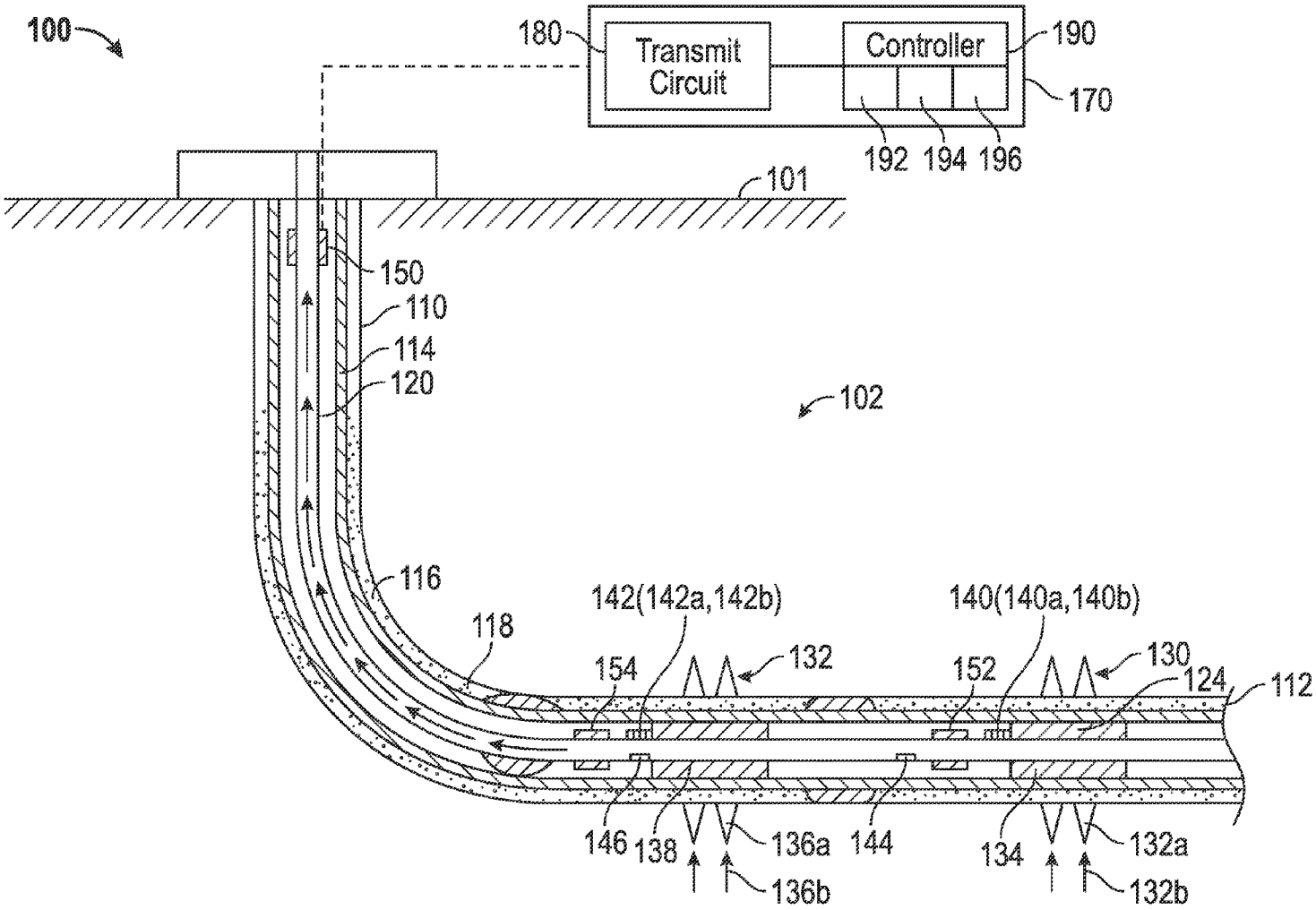
FIG. 1 is a line diagram of an exemplary production well showing two production zones and an EM wave transmitter on a production tubing proximate an end near the surface and a separate EM receiver and a control circuit for operating spaced apart downhole devices.

FIG. 1 show a line diagram of an exemplary production well 100 formed to flow fluids (oil and gas) from a formation 102 to the surface 101. The production well 100 includes well 110 formed in the formation 102 to a depth 112. Well 110 is lined with casing 114, such as a metal tubing. The annulus 116 between the casing 114 and the well 110 is shown filled with cement 118. A production tubing 120 is placed inside the casing 114 to carry the formation fluids to the surface. The exemplary production well 100 is shown to include production zones 130 and 133. Perforations 130*a* in the casing 114 and the formation proximate the production zone 130 enable the formation fluid 132*b* to flow from the formation into casing 114. A flow control device 134 controllably allows the fluid 132*b* to flow into the production tubing 120. Similarly, perforations 136*a* in the casing 114 and the formation proximate the production zone 133 enable the formation fluid 136*b* to flow from the formation into the casing 114. A flow control device 138 controllably allows the fluid 136*b* to flow into the production tubing 120.

In the particular example of production well 110, the flow control device 134 may be operated by a control unit 140, while the flow control device 138 may be operated by a control unit 142, based on one or more downhole conditions and/or in response to a signal sent from the surface via a telemetry system described later. The downhole conditions may include pressure, fluid flow, and corrosion of downhole devices, water content or any other parameter. Sensors 144 may be provided signals to the control unit 140 relating to the selected downhole parameters for determining downhole conditions relating to production zone 130. Similarly sensors 146 may be provided for determining downhole conditions relating to production zone 133. The control unit 140 may further include a receiver circuit 140*a* that receives the signals from its corresponding receiver coil, processes such signals and a device or another control unit 140*b* that controls or operates a downhole device. Similarly, the control unit 142 may include a receiver circuit 142*a* and a device 142*b*.

To operate the downhole tools, in one aspect, an EM telemetry apparatus is provided to transmit signals from the surface to the downhole control units 140 and 142, which control units determine the commands sent from the surface and operate the downhole tools as described in more detail later. In one aspect, the telemetry system includes a transmitter 150 placed on the tubing 120 proximate an upper end of the tubing to induce EM signals in the tubing 120. In one configuration, the transmitter coil 150 may be placed on the outside and around the tubing 120 so that the EM waves or signals induced therein will travel along the outside surface of the tubing 150. A small gap between the tubing 120 and the transmitter coil may be provided. A control unit 170 at the surface may be used to provide electrical signals to the transmitter. The control unit 170, in one aspect, may include transmit circuit 180 and a controller 190. The transmit circuit 180 may include an amplifier circuit that energizes the transmitter at a selected frequency. The controller 190 may include a processor 192, such as a microprocessor, a memory unit 194, such as a solid state memory, and programs 196 for use by the processor 192 to control the operation of the transmit circuit 180 and the transmitter 150. In one aspect, the output impedance of the transmit circuit 180, the impedance of the transmitter coil 150 and that of the tubing 120 are substantially matched. In one aspect, the transmitter output impedance is proximate 50 ohms. In another aspect, the control unit 170 may also be used to receive EM signals sent from a downhole location, such as signals from the sensors 144.

Still referring to FIG. 1, the EM telemetry system further includes at least one receiver on the tubing 120 at location inside the well and at a selected distance for the transmitter 150. In the well configuration of FIG. 1, two receivers are shown. The first receiver 152 is shown placed proximate the first downhole device 134 and the second receiver 154 is placed proximate the second downhole device 138. In one configuration, receivers 152 and 154 may be placed around the outside of the tubing 120. In operation, the receivers 152 and 154 receive EM signals transmitted by the transmitter 150 and traveling along the tubing 120. Receiver circuit 140*a* processes the received signals and the control circuit 140*b* may control or operate the downhole device 134 in response to the instruction contained in the received signals. Likewise, receiver circuit 142*a* processes the EM signals received by the receiver 154 and the device 142*b* may control or operate the downhole device 138 in response to the signals sent for the device 154. In one configuration the transmitted signals are coded and are recognizable by the receiver circuits. In one configuration, both (or all in case of more than two receiver circuits) receivers receive all the transmitted signals but each receiver is configured to decode signals directed for it. In another configuration, a single receiver may be used for operating more than one downhole device. In such a case the receiver processes the received signals and directs different devices via a separate line or a common bus between the receiver and the corresponding downhole devices. In aspects, the transmitter may be configured to send the EM signals at a frequency that is based on the distance between the transmitter and a particular receiver. In aspects, such a frequency provides peak EM signals for that distance. If the distance between the receivers downhole is great, then the transmitter may be configured to transmit at EM signals at different frequencies, one each corresponding to distance between the transmitter and each of the receivers. In other aspects, transmitters may be placed downhole and EM signals may be sent to the surface receiver by the downhole control units 140 and 142. In aspects, the same unit may be used as both the transmitter and the receiver (transceiver). In this manner, the telemetry system provides a two-way EM wireless telemetry via an electrically-conductive member, such as a tubing, between the surface and downhole locations.

Figure 2:
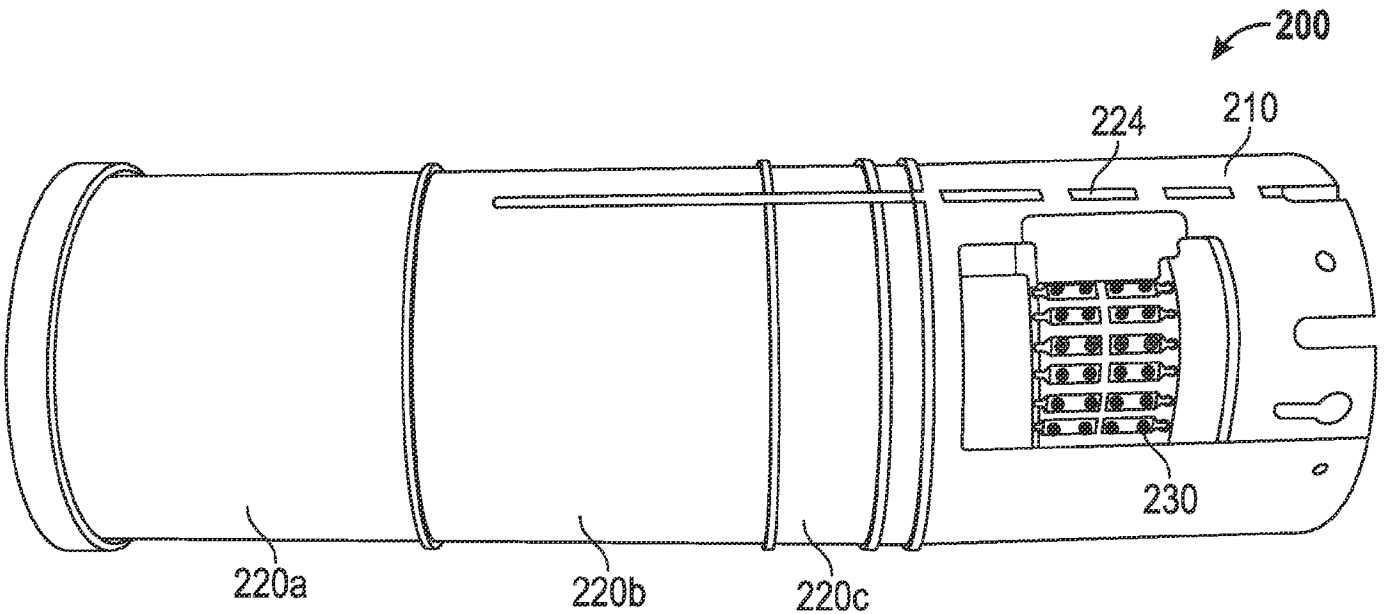
FIG. 2 shows a transmitter/receiver (transceiver) assembly made according to one embodiment of the disclosure.

FIG. 2 shows an exemplary transceiver 200 made according to one embodiment of the disclosure. In general, the transceiver 200 includes a bobbin 210 that has one or more coils, such as coils 220*a*, 220*b* and 220*c* wound around an outside surface of the bobbin 210. Each such coil includes a number of turns depending upon the signals to be transmitted and/or received. Also, the transceiver that is used as a transmitter may have different number of turns compared to the transceiver used as a receiver. In general, the receiver has a larger number of turns because the strength of the signal at the receiver is substantially less than the strength of the transmitted signal. The wire turns may be in one or more layers. In aspects, the transceiver 200 may include provisions for terminating coil leads 224, such as one or more terminal tabs 230. The bobbin 210 may be made from any suitable non-magnetic material, including, but not limited to, a composite material, such as material commercially known as Teflon. Teflon has desirable electrical insulation properties, high operating temperature, such as present downhole, mechanical strength and machinability.

Figure 3:
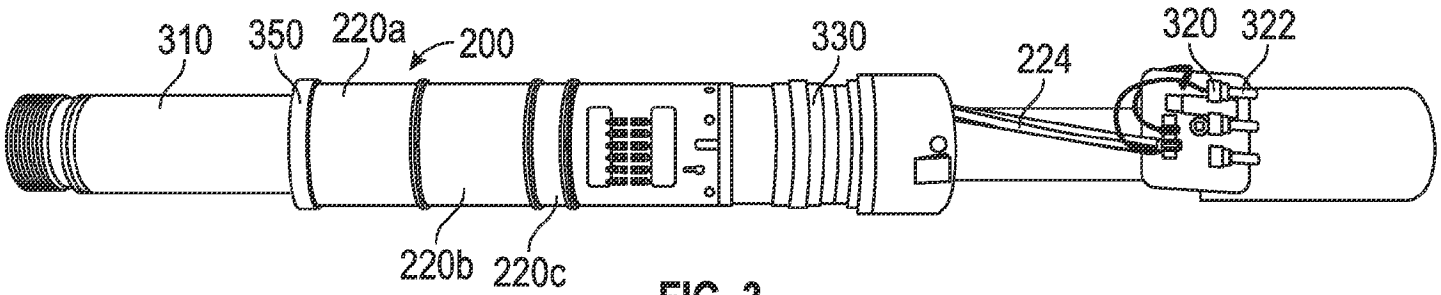
FIG. 3 shows an example of mounting the transceiver on the outside of an electrically-conductive member, such as a tubular in a wellbore.

FIG. 3 shows an example of mounting the transceiver 200 on an outside of an electrically-conductive member, such as a metallic tubular or pipe 310. The transceiver 200, in one configuration, may be placed around the tubular 310 with a gap 350 between the tubular 310 and the inner surface (see element 430*a*, FIG. 4) of the transceiver 200. A support member 330 may be utilized to mount the transceiver 200 on the tubular 310. Lines 224 may be used to connect the coils 220-220*c* to a connector or connection panel 320 that further connects the coils to a controller or control circuit, such as a transmit circuit 180 or a receiver circuit 142*a* shown in FIG. 1.

Figure 4:
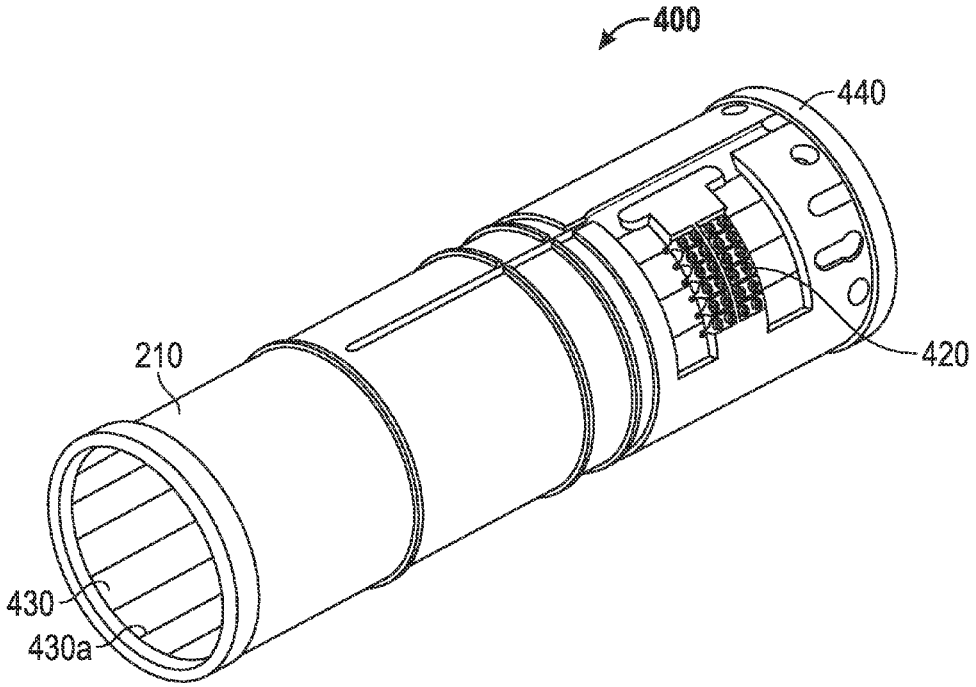
FIG. 4 shows a subassembly of the transceiver of FIG. 3 that includes a bobbin placed around the outside of a sleeve.

FIG. 4 shows a subassembly 400 of the transceiver of FIG. 2 that includes a bobbin 210 placed around a conductive sleeve 430 having an inner surface 430*a* according to one embodiment of the disclosure. In one aspect, the bobbin 210 is securely placed around the sleeve 410. A hub 440, such as a hub made from a metallic material, may be used to provide mechanical support to the transceiver 200. In one aspect, an annular space 350 (not visible) is provided between the inner surface 430*a* of the transceiver 200 and the tubular 310. In other aspects, a non-magnetic (for example. diamagnetic aluminum) mandrel on the inner diameter of the annular space 350 may be provided to allow pipe flow through transceiver 200. Also, structural support across transceiver 200 may be provided to support tubular 310 string load with a ferromagnetic material to allow propagation of the EM signals in the tubular 310.

Figure 5:
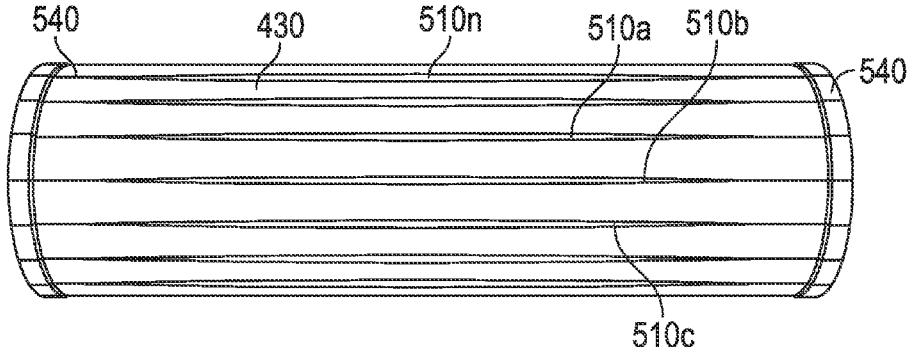
FIG. 5 shows an exemplary sleeve with longitudinal slots for use in the transceiver shown in FIG. 2.

FIG. 5 shows an exemplary sleeve 430. In aspects, the sleeve 430 includes one or more longitudinal or substantially longitudinal slots or slits 510*a*, 510*b* through 510*n*. The slits in the sleeve 430 are provided because eddy currents generated in the sleeve can substantially reduce the strength of the generated EM signal. To contain the electromagnetic signals associated with this transceiver 200, the sleeve is made from a material that exhibits favorable magnetic properties. An example of such a material is M-19 silicon steel. Also, M-19 silicon steel does not have an oriented grain structure and thus does not require a careful orientation of the M-19 silicon steel during fabrication. However, stress can be introduced in the sleeve material during forming of the slits, which can reduce the magnetic properties of the material due to the plastic deformation of the material. One method of reducing the stress on the sleeve 430 is to incorporate relatively narrow or thin laser cut slits. Any other method may also be utilized. In one aspect, the slits 510*a*-510*n* may be approximately 0.010" wide at approximately 0.5" spacing around the sleeve. In another aspect, the sleeve 430 is placed beneath the transmitter coil locations in a manner so as to constrain the plastic deformation of the sleeve material (bend lines that coincide with the slits). In another aspect, the sleeve 430 may include hemmed end 540 that constrains the sleeve 430 in the assembly between the bobbin 210 and the hub adapter 440 shown in FIG. 4. An interference fit between the internal diameter of the sleeve 430 at the hemmed end 540 and the hub adapter 440 creates a conductive interface between the sleeve and the hub for reliable transmission of the electromagnetic signals to the outside of the tubular 310, FIG. 3.

In one configuration, the disclosed apparatus and methods provide wireless signal (or data) transmission via a wellbore pipe, wherein an electromagnetic waves propagate on or along the outside surface and the length of the pipe. The transmitter coils induce an electromagnetic field in the surface (such as the first millimeter or so) of the pipe material. Below the coil, the pipe material is sub-divided so as to not provide a complete conductive path around its circumference (slots). The generated electromagnetic waves travel along the length of the pipe from the transmitter to the receiver. The electromagnetic waves couple to the receiver coil, and into a low noise amplifier and a demodulator. The transmitted EM field may be modulated using a frequency shift keying (FSK), wherein a binary shift in frequency domain encodes either the data as a zero or one, and thus sending telemetry information from the transmitter to the receiver over the length of the pipe.

Several factors present in the wellbore environment attenuate the EM field strength between the transmitter and receiver, such as metallic packers, metallic centralizers, physical contact between casing and tubing, salt water, etc. However, the most significant aspects include the attenuation with the distance between the transmitter and receiver and the standing waves that result from such distance. Therefore, it is advantageous to transmit the EM signals at a frequency that provides peak or near peak values. In one aspect, an optimal frequency at which EM signals are transmitted may be determined by Helmholtz's wave equation for cylindrical coordinates. The Helmholtz's equation describes standing waves along the length of a cylindrical transmission line and provides that for a given length of pipe, there is one and only one frequency for peak transmission. Higher harmonics of such a frequency have lower signal strength, and frequencies in between these harmonics have much lower signal strength. Thus, in one aspect, the transmission frequency in the disclosed system is determined or selected based on the length or spacing of the tubular between the transmitter and the receiver. In wellbore applications, such distance is typically known or during well completion or may be determined after completion of the wellbore. The Helmholtz equation or any other suitable method may be used to determine the transmission frequency. Other methods for determining frequency based on the distance may include simulation or other equations and algorithms.

The foregoing disclosure is directed to the certain exemplary embodiments and methods. Various modifications will be apparent to those skilled in the art. It is intended that all such modifications within the scope of the appended claims be embraced by the foregoing disclosure. Also, the abstract is provided to meet certain statutory requirements and is not to be used to limit the scope of the claims.

The invention claimed is:

1. A telemetry apparatus for use in a wellbore, comprising:

a transmitter at a first location on an electrically-conductive tubular member in the wellbore that induces electromagnetic waves in the electrically-conductive tubular member that travel along an outside surface of the electrically-conductive tubular member, the transmitter including a bobbin placed around the tubular member at the first location with a gap between an inner surface of the bobbin and the tubular member, a transmitter coil wrapped around a circumference of the bobbin, and an electrically-conductive sleeve in the gap between the inner surface of the bobbin and the tubular member, the electrically-conductive sleeve having a plurality of longitudinal slits; and a receiver placed at a second distal location on the electrically-conductive tubular member that detects the electromagnetic waves induced by the transmitter, the receiver including a receiver coil wrapped around a circumference of the electrically conductive tubular member at the second location, wherein the transmitter induces the electromagnetic waves at a frequency determined based on a spacing between the first location of the transmitter and the second location of the receiver.

2. The apparatus of claim 1, wherein the receiver coil is wrapped around an outside of the electrically-conductive tubular member.

3. The apparatus of claim 2, wherein a gap exists between the receiver and the electrically-conductive tubular member.

4. The apparatus of claim 1 further comprising a transmitter circuit supplying electrical energy to the transmitter, wherein an impedance of the transmitter circuit substantially matches an impedance of the electrically-conductive tubular member.

5. The apparatus of claim 1, wherein the frequency is derived using a Helmholtz equation.

6. The apparatus of claim 1, wherein the plurality of longitudinal slits are configured to reduce an effect of eddy currents in the transmitter.

7. The apparatus of claim 1, further comprising a hub at an end of the bobbin that secures the bobbin around the electrically-conductive sleeve.

8. The apparatus of claim 7, wherein the electrically-conductive sleeve includes a hemmed end and the hub secures the hemmed end to the bobbin.

9. The apparatus of claim 8, wherein the hemmed end provides a conductive interface for transmission of the electromagnetic wave to the outside of the tubular.

10. The apparatus of claim 1, wherein the transmitter coil and receiver coil have different number of turns.

11. The apparatus of claim 1 further comprising:

a downhole device; and a receiver circuit that processes the electromagnetic waves detected by the receiver and controls an operation of the downhole device in response thereto.

12. The apparatus of claim 11, wherein the downhole device is selected from a group consisting of: a device in a production well; and a device in a drilling assembly.

13. The apparatus of claim 11, wherein the downhole device is selected from a group consisting of: a flow control device; a sensor downhole; a directional drilling device; a resistivity tool, an acoustic tool; a magnetic resonance tool; a formation testing tool; and a sealing device.

14. The apparatus of claim 1, wherein the tubular underneath the bobbin is sub-divided to prevent a complete conductive path around its circumference.

15. A telemetry apparatus for use in a wellbore having a tubular therein, comprising:

a transmitter comprising:

a bobbin placed around the tubular at the first location with a gap between the an inner surface of the bobbin and the tubular, a first electrically-conductive member having a first plurality of substantially longitudinal slits in the gap between the inner surface of the bobbin and the tubular, wherein with the bobbin is secured around the first electrically-conductive member, and a first coil wrapped around a circumference of the bobbin;

a receiver comprising a second electrically-conductive member having a second plurality of longitudinal slits and a second coil wrapped around a circumference of the second electrically-conductive member, the receiver being disposed around the tubular at a second distal location in the wellbore;

a transmitter circuit configured to cause the transmitter to induce electromagnetic waves in the tubular at a frequency determined based on the distance between the transmitter and the receiver; and a receiver circuit configured to receive electromagnetic wave signals from the receiver responsive to the transmitted electromagnetic wave signals.

16. The apparatus of claim 15, wherein an impedance of the transmitter circuit substantially matches an impedance of the transmitter and the tubular and an impedance of the receiver circuit substantially matches an impedance of the receiver and the tubular.

17. A method of transmitting data along an electrically-conductive tubular member in a wellbore;

transmitting electromagnetic signals representing data along an outer surface of the electrically-conductive tubular member using a transmitter disposed at a first location on the electrically-conductive tubular member, the transmitter including a bobbin placed around the electrically-conductive tubular member at the first location with a gap between an inner surface of the bobbin and the electrically-conductive tubular member, a transmitter coil wrapped around a circumference of the bobbin and an electrically-conductive sleeve in the gap between the inner surface of the bobbin and the tubular member, the electrically-conductive sleeve having a plurality of longitudinal slits;

receiving the electromagnetic waves traveling along the outer surface of the electrically-conductive tubular member responsive to the transmitted electromagnetic waves using a receiver disposed at a second distal location on the electrically-conductive tubular member in the wellbore, the receiver including a receiver coil wrapped around the circumference of the electrically conductive tubular member at the second location, wherein a frequency of the electromagnetic waves is determined from a spacing between the transmitter and the receiver; and determining the data from the received electromagnetic waves.

18. The method of claim 17, wherein transmitting electromagnetic waves comprises operating the transmitter by a transmitter circuit whose impedance substantially matches the impedance of the transmitter and the electrically-conductive tubular member.

19. The method of claim 17 further comprising transmitting the electromagnetic waves at a frequency that has been determined based on the distance between the transmitter and the receiver.

20. The method of claim 17, wherein the transmitter and the receiver are placed on an outside surface of the tubular.

21. The method of claim 17, wherein the transmitter transmits electromagnetic waves at a frequency selected based on distance between the transmitter and the receiver.

22. The method of claim 17 further comprising operating a downhole device in the wellbore in response to the received data.

23. The method of claim 22, wherein the downhole device is selected from a group consisting of: a device in a production well; and a device in a drilling tool.

* * * * *